US006202748B1

(12) United States Patent
Carisella et al.

(10) Patent No.: US 6,202,748 B1
(45) Date of Patent: Mar. 20, 2001

(54) MULTI-STAGE MAINTENANCE DEVICE FOR SUBTERRANEAN WELL TOOL

(75) Inventors: James V. Carisella, Harahan, LA (US); Paul J. Wilson, Houston, TX (US)

(73) Assignee: Weatherford International, Inc., Houston, TX (US)

( * ) Notice: Subject to any disclaimer, the term of this patent is extended or adjusted under 35 U.S.C. 154(b) by 0 days.

(21) Appl. No.: 09/292,529

(22) Filed: Apr. 15, 1999

(51) Int. Cl.[7] ..... E21B 33/127; E21B 33/128
(52) U.S. Cl. ..... 166/187; 166/153
(58) Field of Search ..... 166/96.1, 101, 166/118, 122, 126, 142, 187, 188, 185, 153

(56) References Cited

U.S. PATENT DOCUMENTS

| | | |
|---|---|---|
| 3,160,211 | 12/1964 | Malone . |
| 4,345,648 | 8/1982 | Kuus . |
| 4,349,204 | 9/1982 | Malone . |
| 4,655,292 | 4/1987 | Halbardier . |
| 4,832,120 | 5/1989 | Coronado . |
| 4,869,324 | 9/1989 | Holder . |
| 5,046,557 | 9/1991 | Manderscheid . |
| 5,320,182 | 6/1994 | Mendez . |
| 5,417,289 | 5/1995 | Carisella . |
| 5,469,919 | 11/1995 | Carisella . |
| 5,495,892 | 3/1996 | Carisella . |
| 5,564,504 | 10/1996 | Carisella . |
| 5,718,292 | 2/1998 | Heathman et al. . |
| 5,813,459 | 9/1998 | Carisella . |

FOREIGN PATENT DOCUMENTS

| | | |
|---|---|---|
| 0290114 | 11/1988 | (EP) . |
| WO9836152 | 8/1998 | (WO) . |

OTHER PUBLICATIONS

Article entitled, "Proven Elastomer Compound for Extremely Hostile Geothermal and Oil Field Environments", by Hirasuna, et al., IADC/SPE 11407; 1983 Drilling Conference; Feb. 1983.

Article entitled, "Design and Testing of a High–Performance Inflatable Packer", by Eslinger, et al., SPE 37483; 1997 Production Operations Symposium; Mar. 1997.

*Primary Examiner*—Frank S. Tsay
(74) *Attorney, Agent, or Firm*—Fulbright & Jaworski L.L.P.

(57) ABSTRACT

A thermal compensating apparatus and method for maintaining a substantially constant fluid pressure within a subterranean well tool of the type that includes a bladder that is selectively expandable upon the introduction of pressurized actuation fluid for actuating said tool at a location in a well. A multi-stage piston is movable in a housing. The piston includes a first surface in contact with the actuating fluid and a plurality of second surfaces in contact with well fluid surrounding the apparatus. The combined surface areas of the second surfaces are greater than the surface area of the first surface, so that expansion or contraction changes in the volume of the actuating fluid caused by temperature changes in the vicinity of the tool will result in movement of the piston for maintaining the actuating fluid at a relatively constant pressure.

11 Claims, 7 Drawing Sheets

MULTI-STAGE MAINTENANCE DEVICE FOR SUBTERRANEAN WELL TOOL

BACKGROUND OF THE INVENTION

1. Field of the Invention

The invention relates generally to subterranean well tools such as inflatable packers, bridge plugs or the like, which are set through the introduction of an actuating fluid into an expandable elastomeric bladder and, more particularly, to an apparatus and method that utilize a multi-stage piston with multiple operating surfaces in contact with hydrostatic well pressure for maintaining a relatively uniform fluid pressure in the bladder when the tool is subjected to thermal variants after setting.

2. Description of Problems

It is known among those skilled in the use of these types of inflatable devices that they are subject to changes in inflation pressure when the temperature of the inflation fluid varies from its initial inflation temperature. Typically, an increase in fluid temperature results in increased inflation pressures, and a decrease results in decreased inflation pressures. An increase in inflation pressure can make the tool susceptible to burst failure. A decrease in inflation pressure can diminish anchoring between the tool and the well bore to a point where the tool is not able to provide its intended anchoring function. In both instances, significant changes in temperature in the inflation fluid can result in compromised tool performance and possible tool failure. These failures can result in significant monetary loss and possible catastrophe.

The magnitude of temperature change needed to adversely affect the performance of an inflatable tool depends upon a number of parameters, such as, for example (1) the expansion ratio of the inflation element, (2) the relative stiffness of the steel structure of the inflation element compared with the compressibility and thermal expansion coefficient of the inflation fluid, (3) the relative stiffness of the casing and/or formation compared with the compressibility and thermal expansion coefficient of the inflation fluid, and (4) the inelastic properties of the elastomeric components in the inflation element. There are other factors of lesser significance known to those skilled in the relevant art.

Regardless of the specific values of the aforementioned parameters, conventional inflatable tools cannot tolerate positive or negative temperature changes greater than about 10–15 F.° (5.6–8.3 C.°) from the initial temperature at the end of their inflation cycle. If the temperature of the inflation fluid varies by more than this amount, the tool is subjected to excessive inflation pressures or insufficient inflation pressures, which could result in tool performance problems of the nature described above.

In addition, cycling the inflation fluid temperature within a ±15 F.° of the initial temperature upon expansion can cause stress cycling in the steel structure of the inflation element and in the bladder. There is the potential for a serious problem when the inflation element survives routine thermal cycling for a finite period oftime, during which cyclic damage in the tool accumulates. In such a case, failure can occur at some time after the rig has departed from the well site. Thus, an inflatable tool can provide short term functional performance during low magnitudes of thermal cycling. However, cumulative damage phenomena can occur in steel structures and/or elastomeric components and eventually cause device failure.

A time delayed failure can be more costly and possibly more catastrophic than one which occurs within a short time after the initial setting of the tool. Replacement of the failed device would entail performing a second project about equal in size and expense to the first service operation, instead of the case of a short-lived tool which would fail before the rig is broken down and moved off the site. Operations of this type can cost in excess of one hundred thousand dollars, and as high as several millions of dollars.

There are many operations in the oil and gas industry that successfully use pressure isolation devices which routinely encounter substantial thermal excursions and substantial magnitudes of combined positive and negative thermal cycling. Typically, inflatable devices are excluded as candidates for such projects. Typical projects are listed below.

- large volume stimulation projects, n
- selective zone treatment projects, n
- large volume cement squeeze projects, n
- production packer service in oil and/or gas wells experiencing cooling from Joules-Thompson expansion and cooling of gases, n,c
- production packer service in oil and/or gas wells experiencing heating from deeper produced fluids, p,c
- conversion of a producing well to an injection well and temporary isolation between perforation intervals, n,c
- huff/puff steam injection methods for producing viscous oil formations, p,c

[n=these operations typically result in a large negative thermal excursion (cooling) in the pressure isolation device.]

[p=these operations typically result in a large positive thermal excursion (heating) in the pressure isolation device.]

[c=these projects typically repeated multiple thermal cycling in the pressure isolation device over long periods of time.]

The first five project categories are very common in the industry. Thousands of them are performed per year. The bottom two categories are relatively infrequent with respect to world wide activities.

If conventional packers and bridge plugs are not able to provide service for a given well configuration, because they are not able to pass through restrictions and subsequently set in casing, it is common to use a rig to pull tubing and perform a costly work-over project. The use of thru-tubing inflatable devices provides well known benefits and versatility to the oil and gas industry. Their lack of service worthiness for operations that include thermal cycling and thermal excursions exclude them from a substantial portion of the remedial service sector. An invention that would eliminate the deleterious effects of routine thermal excursions and thermal cycling, would eliminate the aforementioned problems, augment the benefits and versatility of inflatable devices and provide substantial cost savings to operators in the industry.

3. Description of the Prior Art

Subterranean well tools, such as conventional packers, bridge plugs, tubing hangers, and the like, are well known to those skilled in the art and may be set or activated a number of ways, such as mechanical, hydraulic, pneumatic, or the like. Many of such devices contain sealing mechanisms which expand radially outwardly upon the introduction of a substantially incompressible actuating fluid for setting the device in the well to provide a seal in the annular area of the well between the exterior of the device and the internal diameter of well casing, if the well is cased, other tubular conduit, or along the wall of open borehole, as the case may be.

Frequently, the seal is established subsequent to the setting of such device in the well and will be adversely effected by temperature variances of the device or in the vicinity of the device. Such temperature variances can cause expansion or contraction of the sealing mechanism, thus jeopardizing the sealing and even anchoring integrity of the device over time. For example, such devices are typically utilized in well stimulation jobs in which an acidic composition is injected into the formation or zone adjacent a well packer or bridge plug. As the stimulation fluid is injected into the zone, the temperature of the device and the well bore in the vicinity of the formation will be reduced.

If, for example, the well tool utilizes a sealing mechanism that includes an inflatable elastomeric bladder, the temperature of the actuating fluid utilized to inflate the bladder and retain same in set position in the well is affected by the temperature reduction during the stimulation job, causing a reduction of pressure within the interior of the bladder, fluid chambers and communicating passageways within the tool. This reduction in pressure, in turn, causes the bladder to contract from the initial setting position. In more dramatic situations, anchoring of the device in the well bore can be lost and the differential pressures across the device can cause "corkscrewing" of the coiled tubing or work string, resulting in project failure, expensive solution of the corkscrew problem and substantial operational risks.

On the other hand, the same inflatable tool is also adversely affected by an increase in device temperature during certain types of secondary and tertiary injection techniques utilizing, for example, the injection of steam. As the steam is injected into the zone of the well immediate the set packer or well plug, the zone and accompanying devices, including tubing, quickly become exposed to the increased temperature. Some prior art devices containing inflatable packer components have been known to have the inflatable bladder element actually rupture, due to exposure to increased pressure within the bladder and interconnected chambers and passageways as steam flows through the device and is injected into the well zone.

In U.S. Pat. No. 4,655,292, entitled "Steam Injection Packer Actuator and Method," a device is shown and disclosed, which addresses the problems associated with the prior art by providing a mechanism incorporating a compressible fluid, such as nitrogen gas. The fluid is used to accommodate an increase in temperature during steam injection and other operations for preventing the packer mechanism from rupturing as a result of exposure to enhance pressures resulting from the increase of temperature of inflation fluid and device components as stream flows through the device.

PCT application, Ser. No. WO/98/36152, the description and drawings of which are incorporated herein as though fully set forth, describes a thermal compensating apparatus that utilizes hydrostatic well pressure for maintaining a relatively constant pressure in the bladder of an inflatable tool. The apparatus has a piston with a pair of opposed surfaces, which are respectively in contact with the fluid used to actuate the tool and the surrounding well fluid below the tool. The surface in contact with the well bore fluid is proportionately larger in surface area than the surface in contact with the actuating fluid, at a ratio of about 1.4:1 to 1.8:1. Relatively constant hydrostatic well pressure bears on the larger of the surfaces. Referencing off of the hydrostatic well pressure, the piston moves in response to any change in volume and concomitant pressure in the actuating fluid due to temperature changes in the vicinity of the tool, for maintaining a substantially constant pressure in the actuating fluid.

However, the apparatus in the PCT application is not suitable for smaller-diameter thru-tubing tools such as, for example, tools 2⅛" in diameter which are commonly run through 2⅞" tubes that have internal diameter restrictions of 2⁵⁄₁₆" and set in a 7" casing. These thru-tubing tools are inflated to high expansion ratios and therefore are filled with a substantial volume of actuation fluid. The volume of actuation fluid is exceptionally high when compared to the area and volume sweeping capacity of the pressure maintaining piston in a single state device having an intensification ratio of 1.4:1 to 1.8:1. These types of tools do not have a large enough diameter to provide a differential surface area on the respective fluid contact surfaces that is great enough to compensate for temperature variances greater than 10–15 F.°. Because temperature variances in excess of 20 F.° are not uncommon, there is a need for an apparatus that utilizes hydrostatic well pressure for maintaining a relatively constant pressure in small diameter thru-tubing tools in service operations that experience substantial variances in tool temperature while in service.

The present invention addresses these problems associated with the prior art devices, and maintains a relatively constant inflation pressure even when the device experiences single and/or multiple thermal excursions of substantial magnitude. The invention operates to abate the adverse effects of any combination of heating and cooling, both quasi-static and dynamic cycling.

SUMMARY OF THE INVENTION

The present invention provides an improved thermal compensating apparatus over one described in PCT patent application, Ser. No. WO/98/36152. As in the apparatus in the PCT application, the present invention utilizes opposing surfaces with a differential surface area ratio, also referred to as intensification ratio, that is set at the differential between the pressure in the actuating fluid used to set the tool and the relatively constant hydrostatic well pressure. However, a multi-stage piston is utilized so that the surrounding well fluid bears on more than one piston surface so that a relatively constant actuation pressure can be maintained in tools that encounter the most extreme combinations of tool diameter, expansion ratio, and substantial temperature variations, and even at unusually high intensification ratios.

When pressure in the actuating fluid changes due to temperature variations in the vicinity of the tool, the hydrostatic well pressure is in contact with more than one surface of the piston so that the same differential ratio can be utilized as in the apparatus of the PCT application, but in a tool having a much smaller diameter. Instead of utilizing only a pair of opposing surfaces for providing the differential surface area, the improved apparatus utilizes multiple surfaces, arranged tandem, in contact with the hydrostatic well pressure. In this way, a tool having a smaller diameter with contact surfaces having surface areas can be utilized for accommodating temperature variances as great as 200 F.°, even at high intensification ratios.

The apparatus and method provide a multi-stage piston arrangement with multiple surfaces in contact with the surrounding well fluid. This is accomplished by a multi-stage piston with a first surface in contact with the actuating fluid and a multi-stage second piston that has two or more surfaces that remain in contact with the surrounding well fluid. This arrangement allows the use of a relatively large surface area on the first piston in contact with the actuation fluid when compared with the surface area of the same piston area of the apparatus described in the PCT application. This multi-stage piston has two or more surfaces that are exposed to the surrounding well pressure, so that the intensification ratio, which is ratio of the surface areas exposed to the surrounding well fluid to the surface area of the piston exposed to the actuation fluid can be much larger even when the diameter of the invention is small compared with the set diameter of the inflatable tool and when the invention must provide substantial swept volume to maintain a relatively constant actuation pressure when the temperature of the tool varies by as much as ±200 F.°.

BRIEF DESCRIPTION OF THE DRAWINGS

A better understanding of the invention can be obtained when a detailed description of preferred embodiments described below is considered in conjunction with the appended drawings, in which.

DETAILED DESCRIPTION OF PREFERRED EMBODIMENTS

The multi-stage thermal compensating apparatus of the present invention is an improvement over the single-stage apparatus described in PCT application WO98/36152, the drawings and description of which are incorporated herein by reference as though fully set forth. The improved apparatus has particular applicability for service conditions where the diameter of the inflatable tool is less than about 50% of the diameter of the set inflatable tool and the intensification ratio is greater then 1.4:1 and the temperature of the inflatable tool is expected to cycle or significantly depart from its initial temperature at the end of the setting operation, for example the invention is ideally suited for a 1 11/16" diameter tool which is run through 2⅜" tubing or the like, and set in 4" or larger casing. The prior art single stage invention cannot maintain constant actuation fluid pressure when the tool temperature varies by a significant amount. However, the present invention is not limited to tools of that size, and can be used in tools of any size in which a multi-stage piston arrangement can be used for obtaining a suitable intensification ratio for the areas of the surfaces that are in contact with the actuating fluid and surrounding well fluid.

Figure 1:
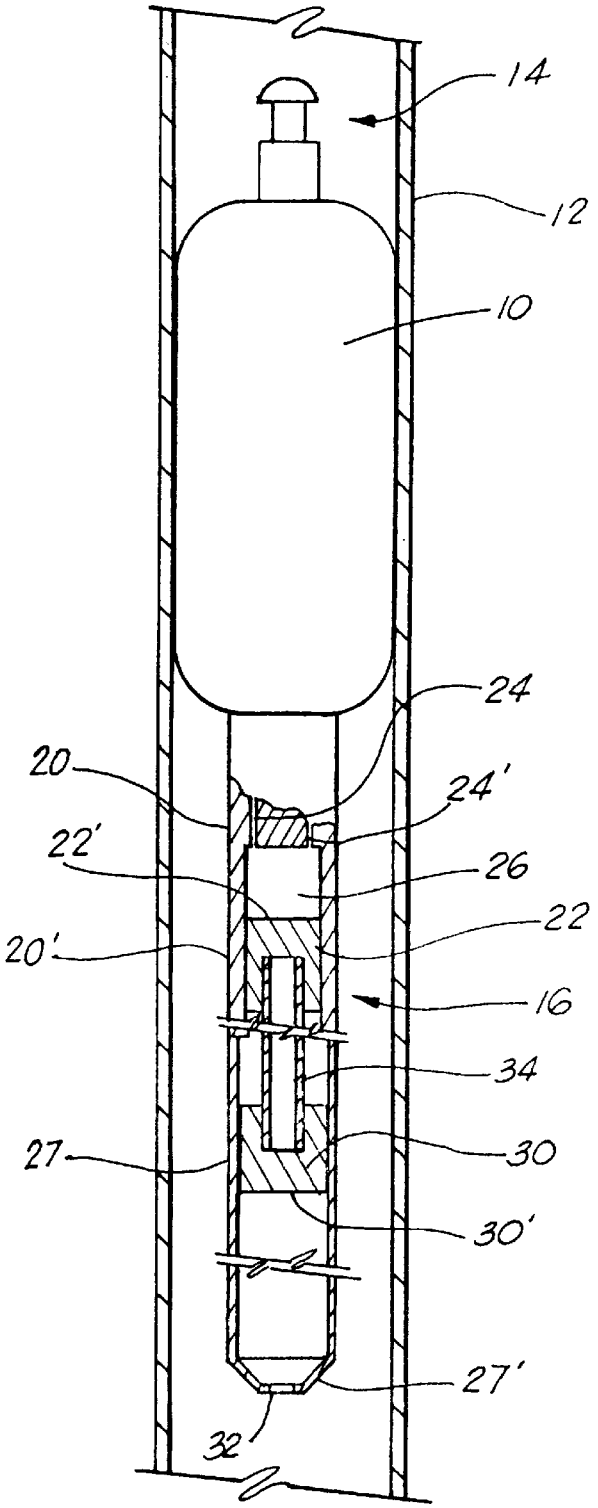
FIG. 1 is a plan view, partially in section, of an expanded tool, such as an inflatable packer, to which a prior art thermal compensating apparatus is connected, such as the one in FIG. 1 in PCT application WO98/36152.

Before describing the apparatus of the present invention, the prior art apparatus described in the PCT application will be described for background information. First, referring to FIGS. 1–3, one embodiment of the prior art thermal compensating apparatus is shown as being connected to an inflatable downhole tool 10, such as a packer, bridge plug or the like. The tool 10 has been inflated in a known manner with a suitable incompressible actuating fluid for setting the tool 10 inside a casing 12. When the tool 10 is inflated as shown schematically in FIG. 1, it establishes and maintains a seal across the internal cross-section of the casing 12. The tool 10 may be set, for example, above a formation zone that produces water or other undesired fluid. As shown in FIG. 1, the tool 10 is connected at its upper most end to a length of coiled tubing 14 or the like, through which a well known type of actuating fluid is transmitted for expanding the tool 10 as shown.

Figure 2:
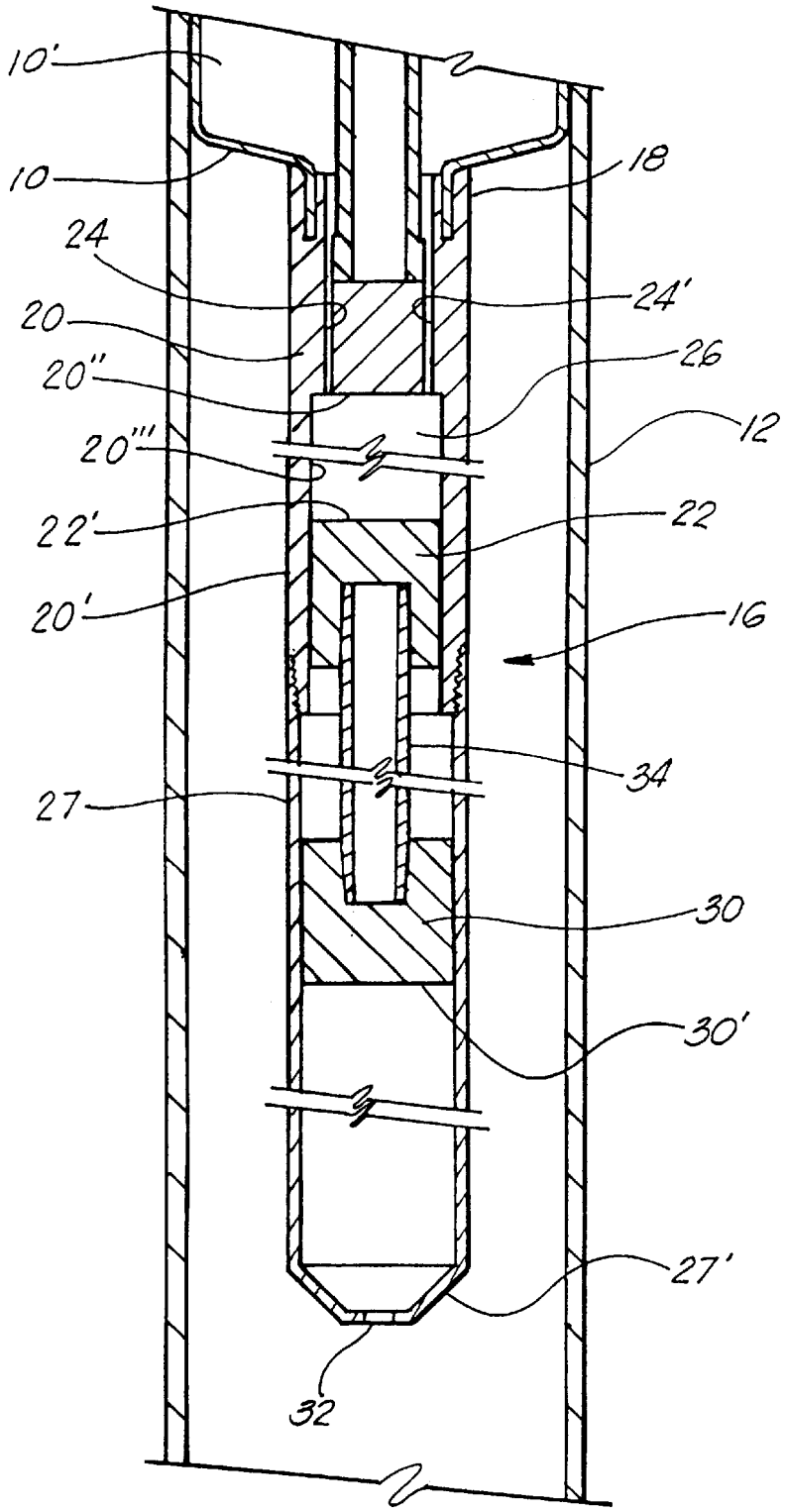
FIG. 2 is a sectional view of the relative positions of the components in the prior art thermal compensating apparatus shown in FIG. 2 of the PCT application, after actuating fluid has expanded the inflatable packer into contact with the well casing.

FIG. 2 shows the internal components of a thermal compensating apparatus 16. An upper housing section 20 is connected to the lower most end of the tool 10 in a known way. A first upper piston 22 is positioned for up and down movement in a portion 20' of the upper housing section 20. A pair of channels 24, 24' extend in the upper housing section 20 between a cavity 10' formed in the tool 10 and a chamber 26, which has an internal surface 20''' and is defined at one end by a downward-facing end surface 20'' within the housing 20, and on the opposite end by an upward-facing end surface 22' of the first piston 22. As described below, the piston end surface 22' is influenced by the fluid pressure inside the tool 10 and the chamber 26.

The housing 20 is threadedly connected at its lower end to the upper end of a lower housing section 27. As shown, the lower housing section 27 has a greater internal area than the internal surface 20''' of the upper housing section. A second lower piston 30 is positioned for up-and-down movement in the lower housing section 27.

The lower housing section 27 has a tapered end 27', which is formed with a central opening 32, so that the lower most end surface 30' of the second piston 30 is continuously influenced by the hydrostatic pressure within the well. The lower piston 30 isolates the well fluids with the actuating fluid that is located in the cylinder 26.

The pistons 22, 30, are connected to each other by means of a central piston rod 34, so that the pistons 22, 30, move up and down in tandem. A space 31 is formed between the pistons 22, 30, which contains air at atmospheric pressure.

The end surface 30' of the lower piston 30 has a substantially larger surface area than the end surface 22' of the upper piston 22. For example, the piston surface 30' may have a surface area 1.1 to 2.0 times larger than the piston surface 22'. This differential maintains the pistons 22, 30, in equilibrium in the position shown in FIG. 2, within the well at the predetermined hydrostatic well pressure and actuating fluid pressure.

When there is a temperature change in the vicinity of the tool 10, which causes the pressure in the actuating fluid to change, the pistons 22,30, automatically move and maintain a substantially constant pressure in the actuating fluid. This pressure compensation is provided by the pistons 22, 30, and the tubular piston rod 34. This piston-based pressure compensator, working with the hydrostatic well pressure as the reference pressure, absorbs or reduces the effective cooling or heating of the actuating fluid used for setting the downhole tool 10. In this way, a relatively constant pressure is maintained within the tool so that its functions are not adversely affected.

One application found for this device is when, for example, water is injected into the formation at a point plugged by the tool 10, so as to displace oil or gas in a secondary recovery project. In such case, the injection water cools the actuating fluid within the downhole tool 10. This in turn causes the actuation fluid to contract. In a conventional tool not having a pressure compensating device this contraction will cause the actuation pressure to decrease. When such a reduction in pressure occurs, there is a risk that the seal provided by the tool 10 may be lost. If the temperature decrease is 15 F.° or greater, the seal and anchoring functions will most certainly be lost. On the other hand, there are conditions when the temperature in the vicinity of the tool 10 is increased relative to the ambient temperature in the well, this would cause an over pressure situation within the tool 10. If the temperature increase is 10 F.° or greater, the tool will most certainly fail in burst.

Figure 3:
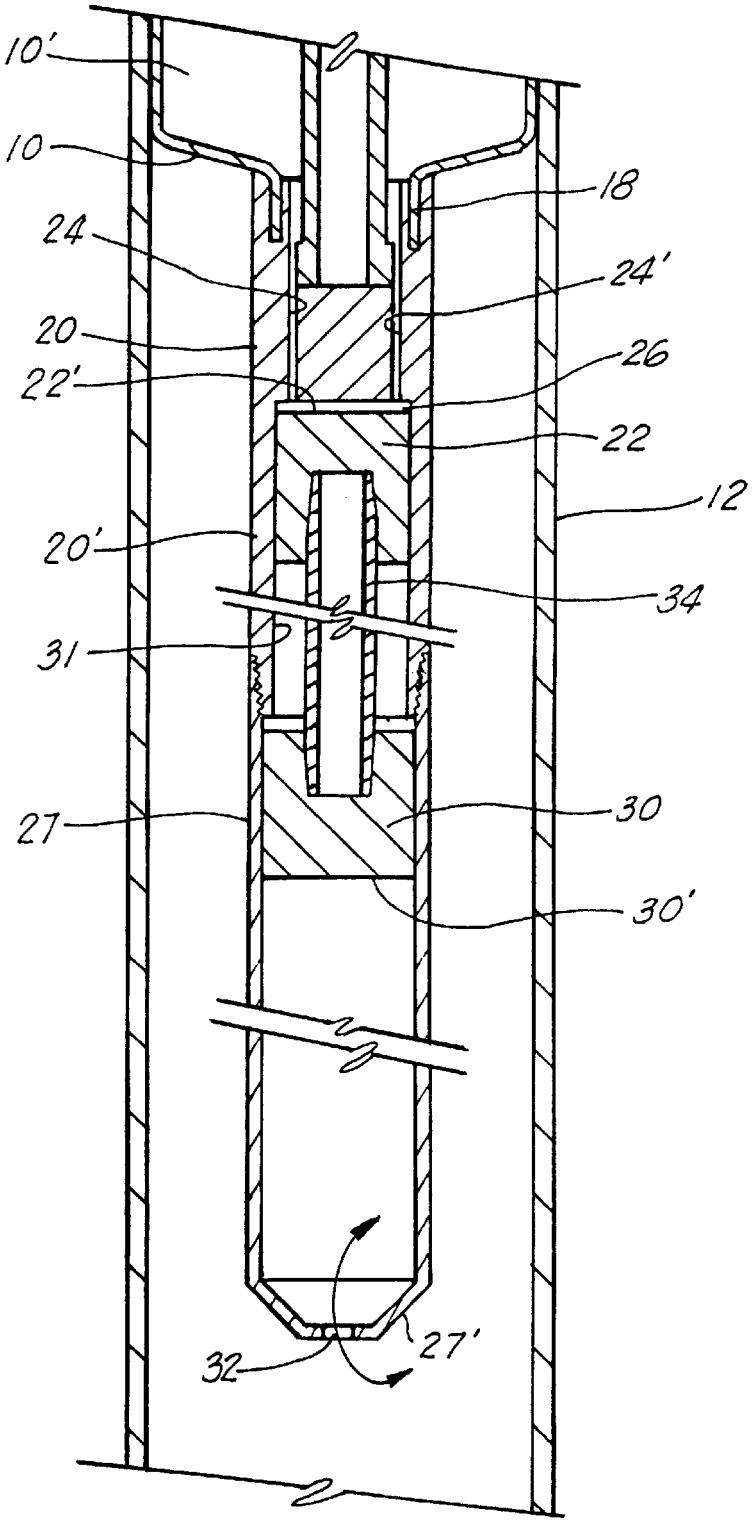
FIG. 3 is a sectional view of the relative positions of the components in the prior art thermal compensating apparatus shown in FIG. 3, of the PCT application, when the actuating fluid is subjected to a decrease in temperature.

By way of example, FIG. 3 shows the positions of the components of the thermal compensating apparatus 16 when there is a decrease of the temperature of the actuating fluid of the tool 10. As shown, the tool 10 has been set by the introduction of pressurized actuating fluid, so that the fluid also flows through channels 24, 24', and into the chamber 26. The hydrostatic well pressure below the set tool 10 remains relatively constant. When the volume of the actuating fluid is decreased due to a decrease in temperature in the vicinity of the tool 10, the pressure of the hydrostatic well pressure fluid bearing on the underside 30' of the piston 30 causes the piston 22 to move upward as shown in FIG. 3 and force actuating fluid from the chamber 26 into the internal cavity 10' for maintaining a substantially constant pressure within the tool 10. In this way, the pressure of the actuating fluid is automatically maintained at a substantially constant level through the action of the hydrostatic well pressure.

The opposite occurs when there is an increase in the temperature in the vicinity of the tool 10. The volume of the actuating fluid increases, causing the fluid to expand into the chamber 26 and move the pistons 22, 30, downwardly. Thus, by using the hydrostatic well pressure as the reference fluid, a substantially constant pressure can be maintained within the tool 10 through the use of the movable pistons 22, 30, as described.

Figure 4:
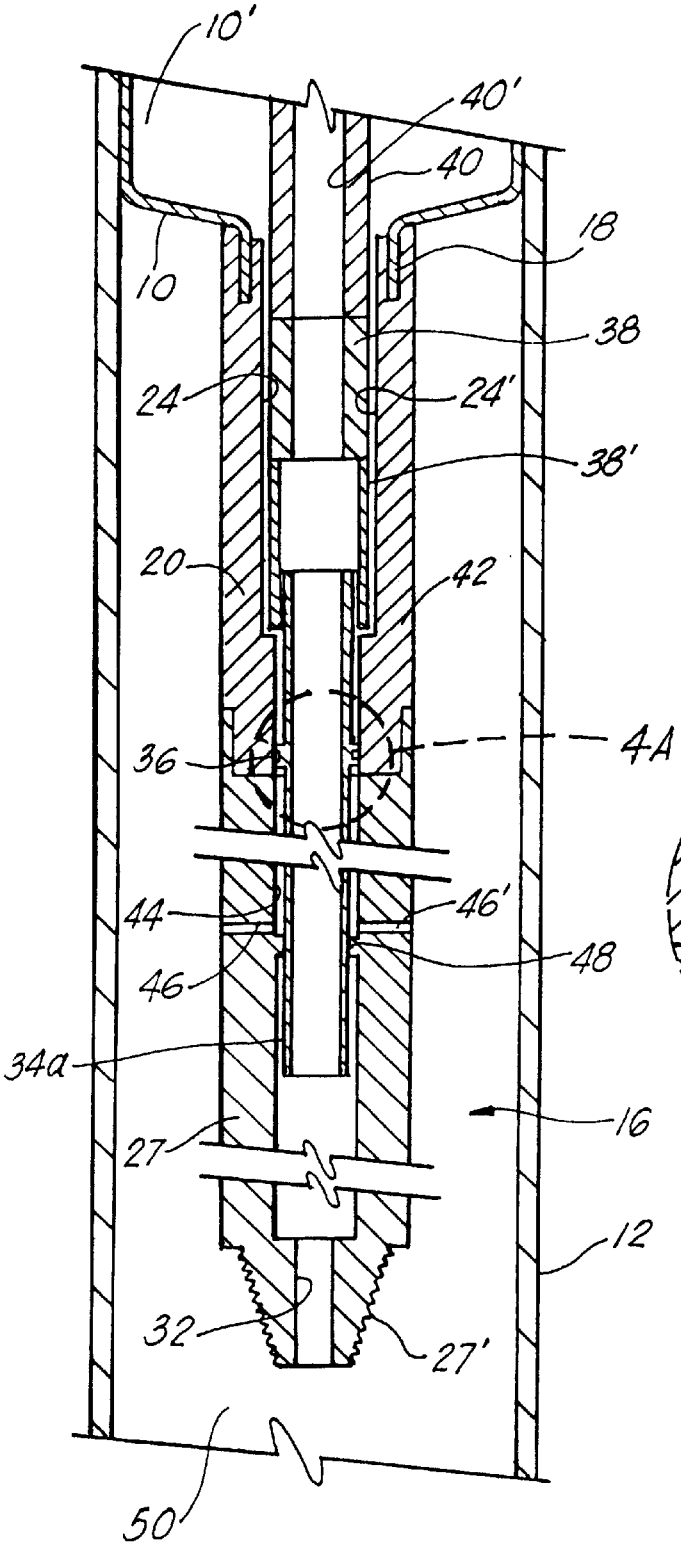
FIG. 4 is a sectional view of a second embodiment of the prior art, single-stage thermal compensating apparatus shown in FIG. 4 of the PCT application.
Figure 4A:
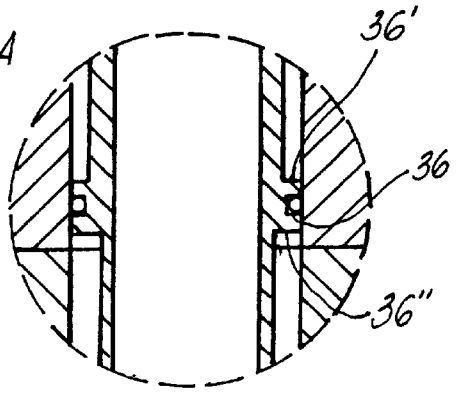
Figure 5:
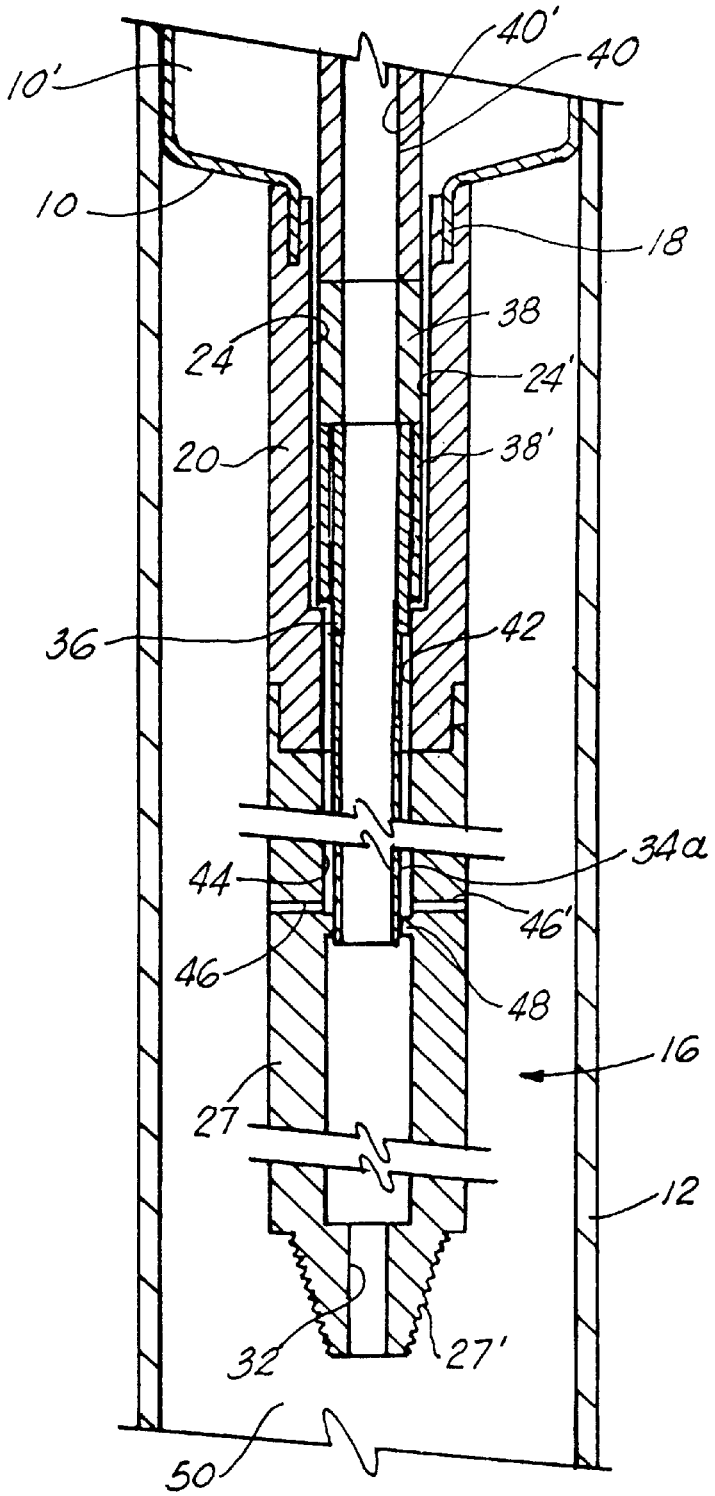
FIG. 5 is a sectional view of the second embodiment of the prior art thermal compensating apparatus shown in FIG. 5, of the PCT application, after the piston is moved upwardly when the actuating fluid is subjected to a decrease in temperature.

A second embodiment of the prior art device describe in the PCT application is shown in FIGS. 4 and 5 which are reproductions of FIGS. 4 and 5 in the PCT application. Briefly, this embodiment is different from the one described above in conjunction with FIGS. 1–3 in the configuration of the pistons, the provision of a central through passage for transmittal of surrounding well fluids, and the use of two axially-spaced seals.

As shown in FIG. 4, a central, tubular piston rod 34*a* is formed with a piston 36 that includes a first piston surface 36' which is in contact with the actuating fluid for the tool 10. The piston surface 36' has a considerably smaller surface area than a second piston 36" which is in contact with the surrounding well fluid. As in the embodiment shown in FIGS. 1–3, the surface area proportion is preferably 1:6.

The upper end of the piston rod 34*a* is movable within a lower section 38' of a concentric inner tube 38 located in the upper housing section 20. The inner tube 38 is connected end-to-end to a co-axial tube 40, which has a bore 40' that extends through the inflated tool 10. The tube section 38' has a relatively large diameter so that the piston 34*a* can move up and down within the tube section 38'. The tube section 38' also is surrounded by longitudinal channels 24, 24' (or alternatively by a concentric annulus, not shown), which as shown in FIG. 4 are connected through a cylinder bore 42 and into contact with the piston surface 36'.

In FIG. 5, the piston rod 34*a* and piston 36 are shown in their uppermost position in the upper housing section 20. This embodiment is particularly suited when two spaced-apart tools 10 are connected to each other. FIG. 5 shows the upper tool with the lower one (not shown) being connected through a lower conical-downward tapering end portion 27' in a tight-fitting manner so that the opening 32 is not exposed to the surrounding well fluid. Instead, the surrounding well fluid is in contact with a cylinder bore 44 through radially-extending ports 46, 46'. A seal 48 is located between the piston 36 and the inner surface of the lower piston housing section 27 for preventing the surrounding well fluid from flowing downwardly into the lower piston housing section 27. Actuating fluid is thus able to flow downwardly through bore 40' and bore 32 in order to set the lower-most tool 10 (not shown), without leaking into a space formed between the tools.

This embodiment operates essentially the same way as the ones shown in FIGS. 1–3. When temperature in the vicinity of the tool 10 decreases, the pressure of the actuating fluid bearing on the piston surface 36' is decreased. The relatively constant surrounding hydrostatic well pressure forces the piston 36 to move upwardly by exerting force against the lower piston surface 36" in order to move the piston upwardly to the position shown in FIG. 5. The opposite occurs when there is an increase in temperature in the vicinity of the tool 10, forcing the piston 36 to move downwardly within the cylinder bore 42.

Because of the typical differential pressures between the actuating fluid used to set the tool 10 and the hydrostatic well pressure, the differential surface areas on the opposing surfaces of the pistons described must be relatively large (for example at a proportion of about 1.4 to 2.0) in order to provide a relatively constant pressure within the tool 10 throughout temperature fluctuations up to ±200 F.°. These design constraints require the diameter of the tool and of the pistons that move up and down within the tool to be relatively large, which prevents them from being used in thru-tubing tools. Single stage apparatuses like those shown in FIGS. 1–5 are limited in serviceability. They are not able to provide pressure maintenance in most thru-tubing inflatable service applications like those described earlier in this text, for reasons also described earlier in this text.

In accordance with the invention, a multi-stage pressure maintenance device is provided which has a wide range of serviceability including but not limited to thru-tubing applications where the relative size of the tool is small, the intensification ratio can be as high as and exceed 2:1, the swept volume of the first piston can be substantial, and actuation fluid pressure can be maintained constant even when the temperature varies by as much as ±200 F.°.

Figure 6:
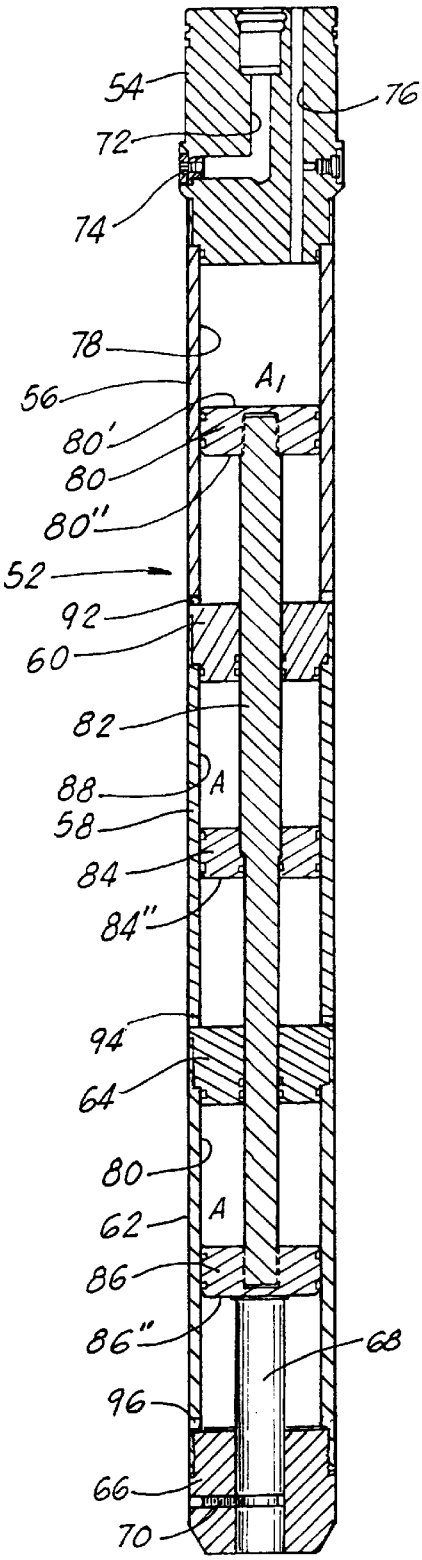
FIG. 6 is a sectional view of the improved, multi-stage thermal compensating apparatus of the present invention.
Figure 7:
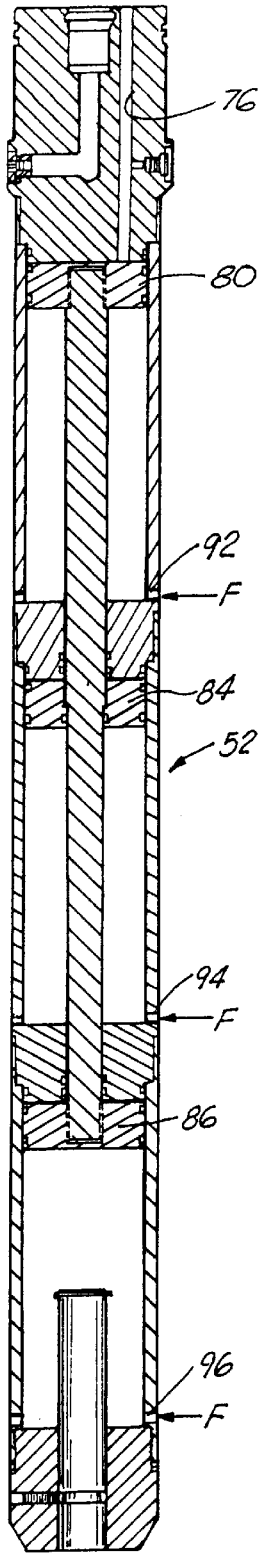
FIG. 7 is a sectional view of the improved thermal compensating apparatus shown in FIG. 6, after the actuating fluid in the tool has been subjected to a decrease in temperature.
Figure 8:
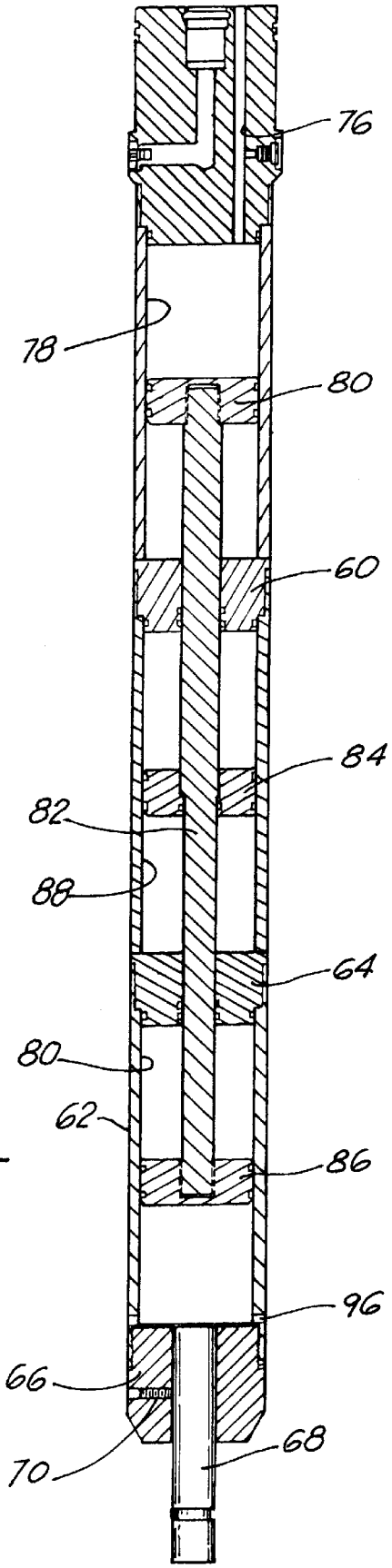
FIG. 8 is a sectional view of the improved thermal compensating apparatus shown in FIG. 6, after the actuating fluid in the tool is subjected to thermal expansion.

As shown in FIGS. 6–8, such an apparatus is provided, which utilizes a multi-stage piston that can be formed with a smaller outside diameter that heretofore possible.

In FIG. 6, a thermal compensating apparatus 52 is shown which is adapted to be connected at its upper end 54 to a tool (not shown) of the type described above. The apparatus 52 includes an upper piston housing 56 that is threadedly connected to the upper end 54, an intermediate piston housing 58 that is connected to the upper piston housing 56 through a guide 60, and a lower piston housing 62 connected to the intermediate piston housing 58 through a guide 64. These sections are all threadedly connected to each other in a known manner. The apparatus 52 also includes a bottom plug 66, is connected to the lower piston housing 62, which includes a rod 68 that is held in place in the plug 66 through a pin 70.

The upper end 54 of the apparatus 52 includes an elbow-shaped bore 72, which is in fluid communication with the actuating fluid used to the set the tool. A rupture disk 74 is located within the bore 72, in a known way, which ruptures when actuating fluid at pre-determined pressure is transmitted to the tool. A check valve mechanism and control head sub-assembly (not shown but of known generic construction to those skilled in the art) will facilitate inflation of the tool with actuation fluid that is in the conduit bore immediately above bore 72. When rupture disk 74 breaches the check valve mechanism will automatically and simultaneously close and trap a finite volume of actuation fluid in the tool and cavity 78.

A second bore 76 extends through the upper portion 54 for providing fluid communication for the actuating fluid between the tool and a chamber 78 formed in the upper piston housing 56. Actuating fluid in the chamber 78 bears against an upper surface 80' of upper piston 80. A rod 82 rigidly connects the upper piston 80 with an intermediate piston 84 located in the intermediate piston housing 58, and a lower piston 86 located in the lower piston housing 62.

All three pistons 80, 84 and 86, all move in tandem through their connections to rigid rod 82. The rod 82 passes through the guides 60, 64, for maintaining alignment as the pistons 80, 84 and 86 move up and down within their respective piston housings.

The piston 84 moves within a chamber 88 formed in the intermediate piston housing 58, and the piston 86 moves within a chamber 90 formed within the lower piston housing 62. The underside of each of the pistons 80, 84 and 86, remain in contact with the surrounding well fluid through passageway 92 in the upper piston housing 56, passageway 94 in the intermediate piston housing 58, and passageway 96 in the lower piston housing 62. In this way, the underside 80" of the piston 80, the underside 84" of the piston 84, and the underside 86" of the piston 86 are exposed to hydrostatic well pressure. The space above the pistons 84, 86 within their respective chambers, is void, i.e., a vacuum exists in the space above pistons 84 and 86. Each of the pistons and guides includes appropriate O-ring seals for isolating each of the chambers and the portions on opposite sides of the pistons from each other.

The apparatus 52, as shown in FIG. 6, is in the "run-in" position before actuating fluid is used to set the tool and before the tool is exposed to hydrostatic well pressure.

The apparatus 52, as shown in FIG. 7, is shown in an intermediate position. The inflatable tool has been expanded. Device 52 is essentially force balanced at the desired inflation pressure after piston face 80' has separated from the bottom of sub 54 and prior to piston face 86" touching item 68. The multi-stage piston rod assembly is force balanced when it resides between these two described end points. The force balance is described by the following equation.

$$AP \times A_1 = BHP\ (A_1 + A_2 + A_3)$$

where:

AP=the pressure of the actuation fluid

BHP=(bottom hole temperature)=well bore pressure outside the tool 52

$A_1$=projected area determined by the bore diameter of housing 56

$A_2$=the projected area determined by the bore diameter of housing 58 less the projected area of piston connecting rod 82

$A_3$=the projected area determined by the bore diameter of housing 62

The intensification ratio is determined by:

$$IR = \frac{A_1 + A_2 + A_3}{A_1} = \frac{AP}{BHP}$$

where:

IR=intensification ratio which is the ratio of the actuation pressure divided by the bottom hole pressure immediately below the tool A force balance always exists in device 52. It is because of the force balance that constant force, i.e., pressure is always exerted on the fluid in chamber 78 and in the tool above. When the volume of the actuation fluid expands or contracts piston 80 travels so as to sweep through a volume equal to the magnitude of volume expansion or contraction while maintaining a constant force on the fluid in chamber 78 and therein maintaining a constant pressure in the actuation fluid.

At the end of the setting cycle piston face 86" presses atop rod 68 which is shear pinned in place by pin 70. The actuation pressure will be caused to increase by continued pumping into the tool. The rupture disk breaches once the actuation fluid pressure reaches the breaching pressure of the rupture disk. As described earlier, the check valve in the control head simultaneously closes with the breach of the rupture disk and the actuation fluid resides in the tool and in bore 76 and cavity 97. Remembering that piston face 86" is atop rod 68, it is evident that contraction of the volume of actuation fluid will cause the piston rod assembly (composed of 80, 82, 84 and 86) to stroke upward away from rod 68 while the device 52 maintains constant pressure of the actuation fluid. While expansion of the volume of actuation fluid will cause the piston rod assembly to press down upon rod 68 and to shear pin 70. Once pin 70 is sheared, rod 68 is unsecured and offers no resistance to downward motion of the piston rod assembly. This is shown in FIG. 8.

The combination of rupture disk 74, rod 68 and shear pin 70 allows the positioning of the piston rod assembly so that the desired initial actuation pressure (the initial setting pressure) can be achieved while positioning the piston rod assembly so that contraction and expansion of the actuation fluid can be accommodated after the tool is set.

If a decrease in temperature occurs within the vicinity of the tool, causing a contraction of the actuating fluid, surrounding well fluids move in the direction of arrows F (FIG. 7) and bear against the undersides 80", 84" and 86", of the pistons 80, 84 and 86, respectively, and cause the piston 80 to move upwardly for maintaining a substantially constant pressure within the actuating fluid. The converse occurs if there is a temperature increase within the vicinity of the tool, causing an expansion of the actuating fluid, which in turn causes the pistons 80, 84 and 86, to move downwardly for maintaining a substantially constant pressure within the actuating fluid.

In this way, by utilizing a multi-stage piston arrangement, a much smaller diameter thermal compensating apparatus can be used in conjunction with thru-tubing tools, which has heretofore not been possible. In this way, the integrity of the seal of the downhole tool is maintained, without danger of rupture, due to pressure variance within the vicinity of the tool.

Although the invention has been described in terms as specified embodiments which are set forth in detail, it should be understood that this is by illustration only and that the invention is not necessarily limited thereto, since alternative embodiments and operating techniques will be come apparent to those skilled in the art in view of the disclosure. Accordingly, modifications are contemplated which can be made without departing from the spirit of the described invention.

What is claimed is:

1. A thermal compensating apparatus for maintaining a substantially constant fluid pressure within a fluid pressure actuated subterranean well tool, said apparatus comprising:

(a) a piston housing;

(b) a multi-stage piston movable in the housing;

(c) said piston including a first piston surface in contact with said well tool actuating fluid;

(d) said piston further including a plurality of second surfaces in contact with well fluid surrounding said apparatus; and (e) said plurality of second surfaces having a combined surface area that is greater than the surface area of the first piston surface.

2. A thermal compensating apparatus for maintaining a substantially constant fluid pressure within a subterranean well tool of the type that includes a bladder that is selectively expandable upon the introduction of pressurized actuation fluid for actuating said tool at a location in a well, said apparatus comprising:

(a) a piston housing;

(b) a multi-stage piston movable in the housing;

(c) said piston including a first piston surface in contact with said actuating fluid;

(d) said piston further including a plurality of second surfaces in contact with well fluid surrounding said apparatus; and (e) said plurality of second surfaces having a combined surface area that is greater than the surface area of the first piston surface, so that changes in the pressure of the actuating fluid caused by temperature variations in the vicinity of the well tool will result in said piston moving for maintaining the actuating fluid at a substantially constant pressure.

3. The apparatus of claim 2, wherein the multi-stage piston includes three piston sections connected through a rod so that the piston sections can move in tandem.

4. The apparatus of claim 3 wherein said three pistons include an upper piston, the upper surface of which forms said first surface.

5. The apparatus of claim 3, wherein said three pistons include lowermost surfaces which form the plurality of second surfaces in contact with well fluids surrounding said apparatus.

6. The apparatus of claim 2, wherein the ratio of surface area of the first piston surface to the surface area of each of the plurality of second surfaces is about 1:1.5–1.6.

7. A method for maintaining a substantially constant fluid pressure within a subterranean well tool of the type that includes a bladder that is selectively expandable upon the instruction of a substantially incompressible actuation fluid under pressure for actuating said tool at a location in a well, said method comprising the steps of:

(a) providing a multi-stage piston movable in a piston housing, said piston including a first piston surface in contact with said actuating fluid;

(b) maintaining a plurality of second surfaces on said multi-stage piston in contact with well fluids surrounding said apparatus, wherein changes in pressure in the actuating fluid caused by temperature changes in the vicinity of the tool will cause the multi-stage piston to move for maintaining constant pressure in the actuating fluid.

8. The method of claim 7, wherein the multi-stage piston includes three pistons connected through a rod so that the pistons will move in tandem.

9. The method of claim 8, further including the step of actuating fluid being in contact with the uppermost surface of the uppermost piston.

10. The method of claim 8, and further including the step of maintaining well fluid in contact with the lowermost surface of each piston.

11. The method of claim 7, and further including the step of providing a ratio the surface area of the first piston surface to the surface area of each of the plurality of second surfaces at about 1:1.5–1.6.

* * * * *

UNITED STATES PATENT AND TRADEMARK OFFICE

CERTIFICATE OF CORRECTION

PATENT NO. : 6,202,748 B1
DATED : March 20, 2001
INVENTOR(S) : Carisella et al.

It is certified that error appears in the above-identified patent and that said Letters Patent is hereby corrected as shown below:

Title page,
Item [54], after "MULTI-STAGE" please insert -- PRESSURE --.

Column 1,
Line 1, after "MULTI-STAGE" please insert -- PRESSURE --.
Line 58, delete "oftime" and insert -- of time -- therefor.

Column 8,
Line 61, delete "that" and insert -- than -- therefor.

Column 9,
Line 10, delete "the".

Column 11,
Line 5, delete "be come" and insert -- become -- therefore.

Signed and Sealed this

Eleventh Day of September, 2001

*Attest:*

Nicholas P. Godici

*Attesting Officer*

NICHOLAS P. GODICI
*Acting Director of the United States Patent and Trademark Office*